US005609528A

United States Patent [19]

Kehoe

[11] Patent Number: 5,609,528

[45] Date of Patent: Mar. 11, 1997

[54] COMPACT GOLF DRIVING RANGE NET

[76] Inventor: Robert P. Kehoe, 1515 Beechurst Ct., Houston, Tex. 77062

[21] Appl. No.: 626,921

[22] Filed: Apr. 3, 1996

Related U.S. Application Data

[63] Continuation of Ser. No. 359,411, Dec. 20, 1994, abandoned.

[51] Int. Cl.[6] ..... A63B 69/36

[52] U.S. Cl. ..... 473/157; 473/197

[58] Field of Search ..... 473/197, 157

[56] References Cited

U.S. PATENT DOCUMENTS

| | | | |
|---|---|---|---|
| 1,218,390 | 3/1917 | Gates | 473/194 |
| 1,669,640 | 5/1928 | Warlick | 473/163 |
| 3,390,882 | 7/1968 | Megerle | 473/194 |
| 3,420,528 | 1/1969 | Day | 273/182 R X |
| 3,895,809 | 7/1975 | Shockley | 473/194 |
| 4,381,110 | 4/1983 | Balaz | 473/197 |
| 4,556,219 | 12/1985 | Tillery | 473/197 |
| 4,703,931 | 11/1987 | Steen | 473/197 X |
| 5,018,731 | 5/1991 | Doyle | 473/166 X |
| 5,306,009 | 4/1994 | Bolanos | 473/157 |

*Primary Examiner*—William H. Grieb
*Attorney, Agent, or Firm*—Kenneth A. Roddy

[57] ABSTRACT

A compact golf ball driving range net apparatus has a rigid frame with a substantially fabric ramp 14 having a lower leading edge 60 releasably connected to a lower portion of the frame and an upper trailing edge releasably connected to an upper end of the frame. The ramp 14 curves upwardly from the leading edge 60 to the trailing edge and is supported on the frame in a substantially tensioned state. A generally cylindrical ball receiving member 12 supported generally horizontally at an upper end of the frame has a longitudinal opening 110 adjoining the ramp trailing edge for receiving a ball thereinto. Golf balls hit from an adjacent teeing area 82 impact the ramp and are guided upward thereby to enter and rotate along the interior of the ball receiving member a number of times under observation of the golfer. The path of the rotating ball indicates the manner in which it was hit.

17 Claims, 8 Drawing Sheets

COMPACT GOLF DRIVING RANGE NET

This is a continuation of application Ser. No. 08/359,411, filed Dec. 20, 1994 abandoned.

BACKGROUND OF THE INVENTION

1. Field of the Invention

This invention relates generally to compact golf driving range nets, and more particularly to a compact driving range net which allows the golfer several seconds of direct visual feedback on the basic flight characteristics of the golf ball in addition to stopping the golf ball safely.

2. Brief Description of the Prior Art

Prior art golf driving range nets are primarily directed toward nets which safely stop golf balls hit in practice after a very short flight. This has generally been done by having the golf ball expend the majority of its energy impacting one or more layers of vertically suspended or tensioned netting and/or being captured by a fabric curb, of sorts, although the structure and configuration of the art varies widely. By arresting the ball so very early in its flight, knowledge of the basic flight characteristics are, for the most part, lost. Even if a golfer hits a circular-shaped target suspended in front of a vertically hung net, there is no feedback to the golfer that would indicate if the shot was heading left or right of the intended line. This critical information is lost. The present invention provides an extended period of direct visual observation of the golf ball after impact.

Hitting actual golf balls in a practice session and studying the resultant flight of the ball is essential for learning to develop a sound golf swing and playing the game of golf well. It is simply unrealistic to believe that a golfer would be able to develop a sound golf swing by swinging only a weighted training club; or only a "hinged" golf club; or only a device that trains the golfer to swing a golf club on the proper swing plane. Most importantly, it is unrealistic to believe that a golfer can develop a good swing by only hitting into a net that provides little feedback on the resulting flight of the ball past a point where it is typically terminated into an elastic net.

There is simply no substitute for hitting real golf balls and being able to observe their basic flight characteristics, i.e., did the shot go left or right? Unfortunately, hitting into a net that merely stops the ball safely deprives the golfer of important feedback about the struck shot. The present invention will allow the golfer to know if the ball was not only struck solidly, but more importantly, if the shot was pushed, pulled, hooked or sliced with regard to the intended line of flight. In short, the present invention promises to provide effective and real practice while offering immediate feedback on the resultant shot.

The primary reason that a golfer goes to an outdoor driving range is to observe the true flight of the golf ball, unfortunately the golfer has no practical alternative if an outdoor driving range is unavailable. In addition, making a trip to a driving range can be time consuming and costly over the long term. Thus, the golfer could greatly benefit from a device that allows the following; the benefit of hitting real golf balls in as timely a manner as practical by having a practice net located at his/her residence; direct feedback on ball flight during the development of a sound golf swing; and realization of significant cost savings from using the same bucket of golf balls over and over again.

Many inventors have created golf practice nets. None of these devices allow the golfer sufficient feedback to be able to know if the ball was struck well, not just solidly. The present art of compact nets has one common drawback, the flight of the golf ball is interrupted so very early by impacting an arresting target area only a few meters ahead of where the ball was struck. At impact the continuing character of the shot is terminated so the golfer does not learn it the shot was headed left or right of the intended line of flight.

Electronic devices such as lighted sticks, projecting beam clubs and floor mounted sensors can predict the path of the ball by sensing the club head speed and orientation at impact but usually are expensive or require a relatively large range located indoors. And lastly, these methods are very unnatural and may not offer the benefits of striking a real golf ball.

The prior art does teach various golf ball driving practice and training devices comprised of frame structure and receiving netting to serve as a means whereby golfers may conveniently and easily practice driving golf balls in a small area. The following U.S. patents disclose various types of devices which utilize flexible netting for safely arresting golf balls.

Day, U.S. Pat. No. 3,420,528 discloses a ramp-like net which can guide a golf ball upwardly into a spiraling fabric capture device. Unfortunately, the golfer is left unaware of the resultant path of the golf ball because its flight was arrested immediately after being struck at the top of the ramp by the spiral fabric capture structure.

Balaz, U.S. Pat. No. 4,381,110 discloses a device that only stops the golf ball safely.

Tillery, U.S. Pat. No. 4,556,219 discloses a typical cage type driving range that offers little feedback on the flight of the golf ball. The primary improvement with the Tillery device is that it safely arrests the golf ball and reduces dangerous rebounds from the floor.

Steen, U.S. Pat. No. 4,703,931 is typical of many practice nets. While not solely intended for golf, it embodies basic principles of netting and rigid frame in a unique configuration. Again, a shortcoming is not providing feedback on the flight of the ball and is merely satisfied with safely arresting the golf ball.

Likewise, the following U.S. patents disclose various types of devices which utilize panels or a stiffer fabric such as canvas to absorb a direct impact.

Gates, U.S. Pat. No. 1,218,390 discloses a device that provides little flight information feedback and only arrests the flight of the golf ball safely.

Warlick, U.S. Pat. No. 1,669,640 discloses a device providing a netting and frame assembly and a sloping impact net. However, the flight of the golf ball is terminated within a few meters of flight by a vertically suspended net.

Megerle, U.S. Pat. No. 3,390,882 discloses a device providing self-supporting panel assembly. Again suffering from an early termination of the in-flight golf ball.

Shockley, U.S. Pat. No. 3,895,809 discloses a device which allows less security than a fuller enclosure and lacks any flight feedback on the struck shot because it turns the ball horizontally. This device could also produce a dangerous and uncontrolled ricochet thereby placing the golfer and those around him or her at risk.

Doyle, U.S. Pat. No. 5,018,731 discloses an apparatus which only slightly improves the feedback on the flight of the golf ball by allowing the ball to travel farther before it impacts the target because of its larger overall cage size. It is not easily relocated nor located in the back yard of the typical golfers home. And it is designed for use with only a few golf clubs.

Bolanos, U.S. Pat. No. 5,306,009 discloses a ramp-like net and a wrapped net-like barrier that can safely arrest a golf ball. While being a very clever development, this device does not provide feedback on the resultant flight of the ball. The golfer is still left wondering if the ball was headed left or right.

The present invention is distinguished over the prior art in general, and these patents in particular by a golf ball driving practice net apparatus having a flexible receiving apparatus adapted to quickly and safely absorb the kinetic energy of a driven golf ball and which has a cylindrical shot receiving member in which the ball rotates to offer extended direct visual feedback on the basic flight characteristics of the ball which has been hit.

SUMMARY OF THE INVENTION

It is therefore a principal object of the present invention to provide a compact golf driving range net apparatus for either indoor or outdoor use by golfers in practicing golf shots, which is easily relocatable, and can be located at the golfers residence.

It is another object of the present invention to provide a golf ball driving range net apparatus having a flexible receiving apparatus adapted to quickly and safely absorb the kinetic energy of a driven golf ball while allowing the ball to rotate inside a capture device that offers extended direct visual feedback on the basic flight of the golf ball.

Another object of the present invention is to provide a golf ball driving range net apparatus which is self-contained and of sturdy weather resistant construction, yet sufficiently mobile as to be easily disassembled and moved from one location to another.

Another object of the present invention is to provide a golf ball driving range net apparatus wherein the apparatus may be erected and installed in locations convenient to the golfer affording easy and quick practice or warmup prior to a round of golf.

Another object of the present invention is to provide a compact golf driving range net apparatus that does not require sophisticated mechanical or electrical devices to operate.

A further object of the present invention is to provide a golf ball driving range net apparatus which does not require the golfer to pay a daily use fee or cost, and allows the golfer unlimited reuse of golf balls.

A still further object of this invention is to provide a compact golf driving range net apparatus that is easily manufactured at a reasonable cost.

Other objects of the invention will become apparent from time to time throughout the specification and claims as hereinafter related.

The above noted objects and other objects of the invention are accomplished by the present golf ball driving practice net apparatus having a flexible receiving apparatus adapted to quickly and safely absorb the kinetic energy of a driven golf ball and which has a cylindrical shot receiving member in which the ball rotates to offer extended direct visual feedback on the basic flight chracteristics of the ball which has been hit.

DESCRIPTION OF THE PREFERRED EMBODIMENT

Figure 1:
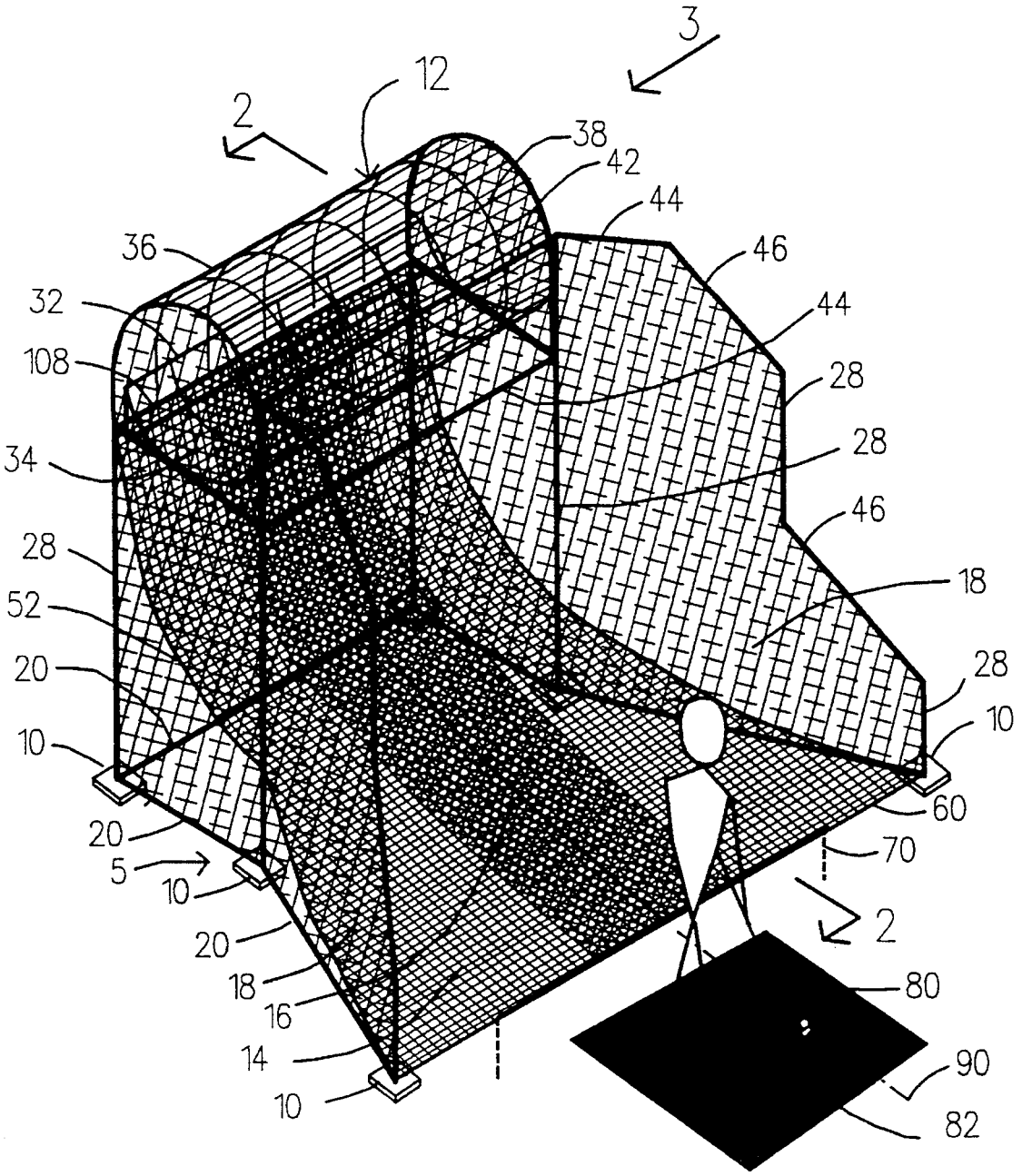
FIG. 1 is a perspective view of the entire compact golf driving range net apparatus showing a representative golfing figure in a teeing area.
Figure 2:
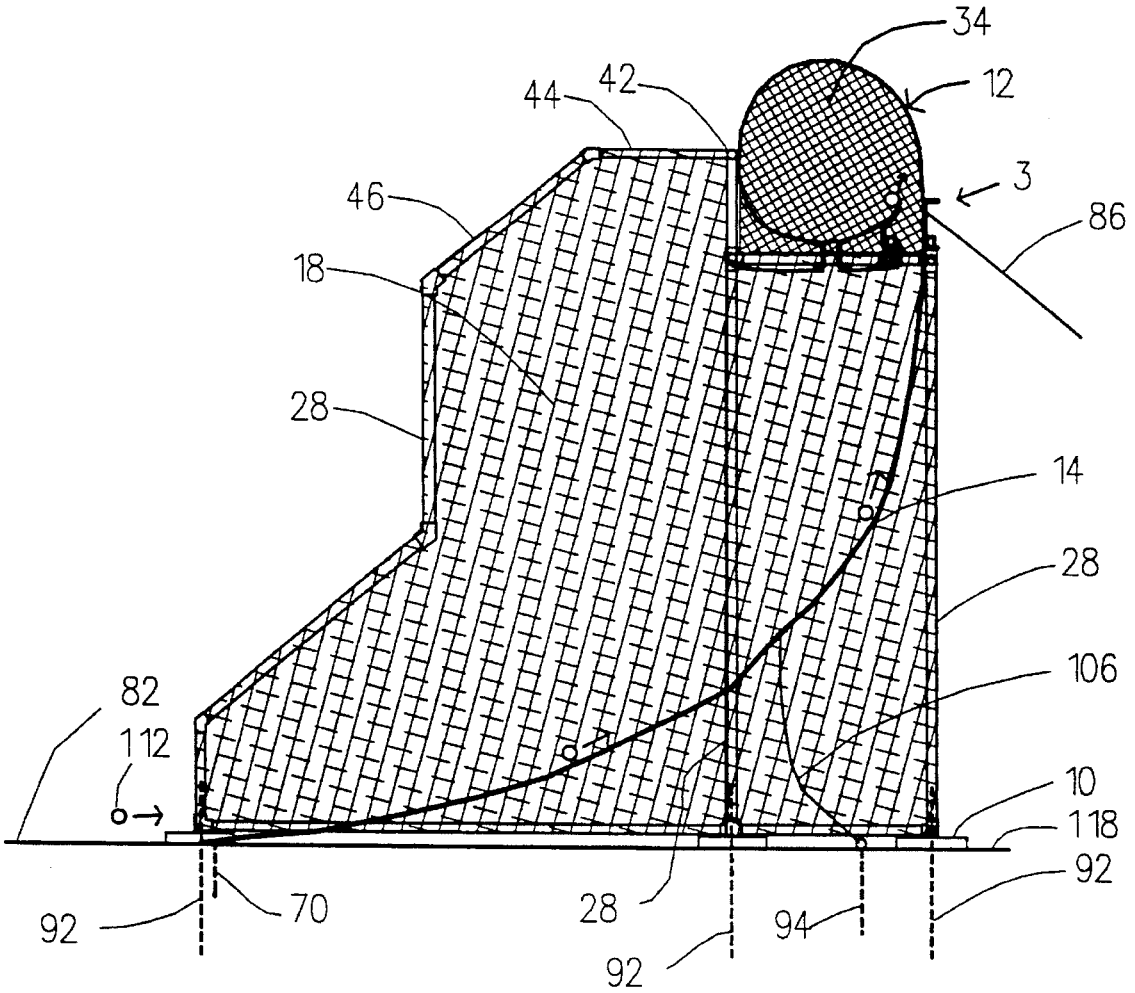
FIG. 2 is a cross sectional view of the entire compact golf driving range net taken along line 2—2 shown in FIG. 1.

Referring to the drawings by numerals of reference, the entire compact golf driving range net apparatus is shown in FIGS. 1 and 2. The three major components of the device are: a frame of rigid support elements and side safety netting 18; a semi-rigid, tensioned, upwardly curving main impact net fabric ramp 14; and a self-supporting, open mesh, cylindrical shot receiver 12. In the erected configuration, the cylindrical shot receiver 12 will allow a golf ball to rotate and spiral under centrifugal force until its energy is spent (as described hereinafter). The net assembly frame is supported on a footpad assembly 10 and may be located in a yard of the golfer or assembled indoors or located at a golf facility in a permanent location. A teeing area 82 is positioned a distance in front of the net assembly (left side of the drawing in FIG. 2) from which golf balls will be driven.

The frame is constructed of horizontal tubing members 20 and 44, vertical tubing members 28, and sloped tubing members 46. The tubing members 20, 28, 44, and 46 carry the structural loads to the foot pad assemblies 10. A pair of shot receiver tube supports 42 are connected to the rearmost pairs of vertical tubing members 28 for supporting the cylindrical shot receiver 12. The tubing members 20, 28, 42, 44, and 46 are made of rigid steel, aluminum or plastic and are connected to each other by tubing connectors 134 or other suitable fastening means.

Figure 5:
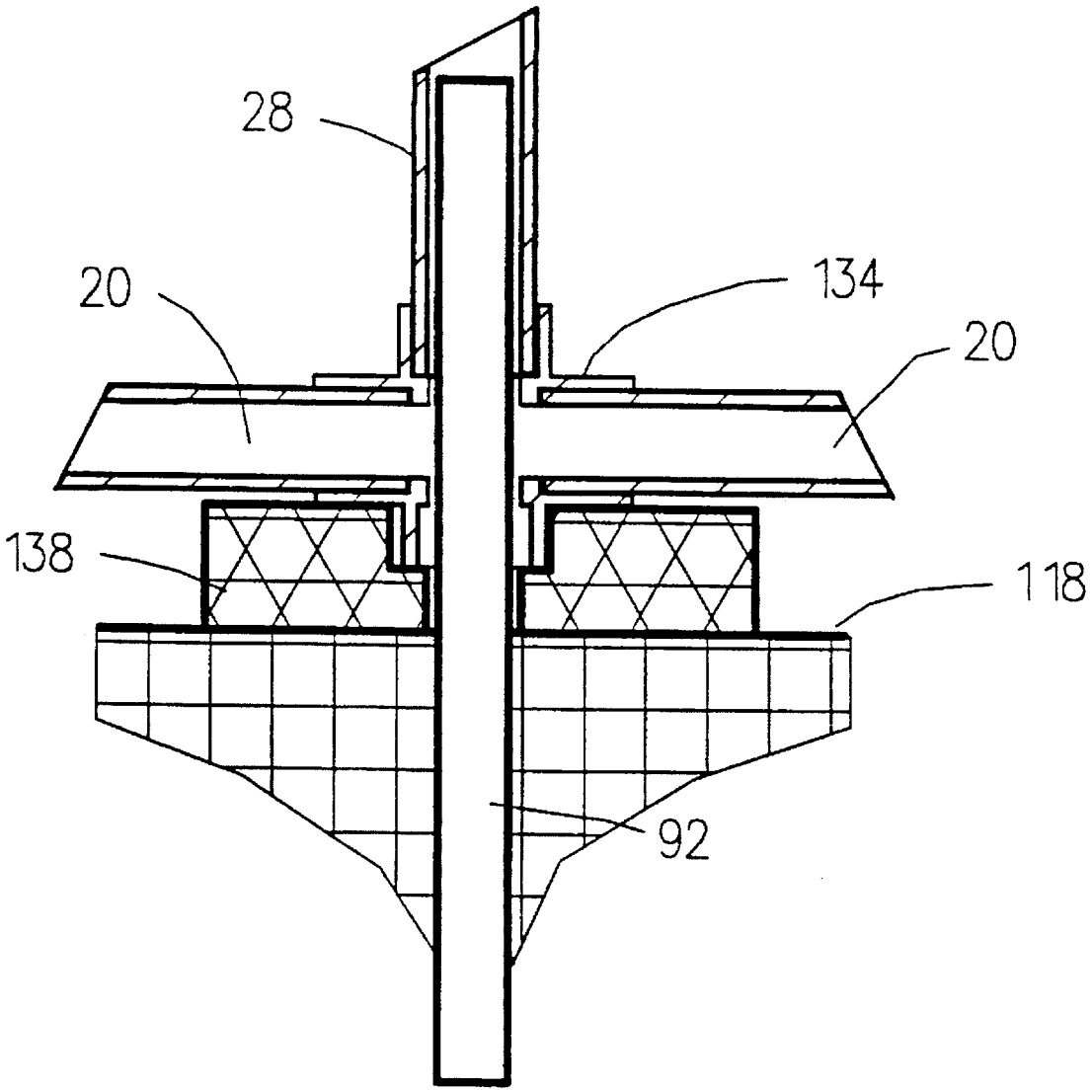
FIG. 5 is a large scale cross sectional view of a typical foot pad that distributes the weight of the device to the ground plane.

A typical footpad assembly 10 is shown in larger scale in FIG. 5. A footing pad block 138 of wood, plastic or metal is supported on the surface 118 of the ground or floor and receives the structural loading from vertical frame tubing members 28 and horizontal frame tubing members 20 via a tubing connector 134 mounted on the block 138. The upper end of a long plastic or metal stake 92 installed through the footing pad block 138 is received through the connector 134 and inside the vertical frame tubing members 28 to restrain the net aparatus laterally. Use indoors would not require use of long stakes 92. As shown in FIG. 2, the net assembly would be further secured with guy wires 86 when located outdoors. Other guy wires would be attached to other key points on the frame.

Figure 3:
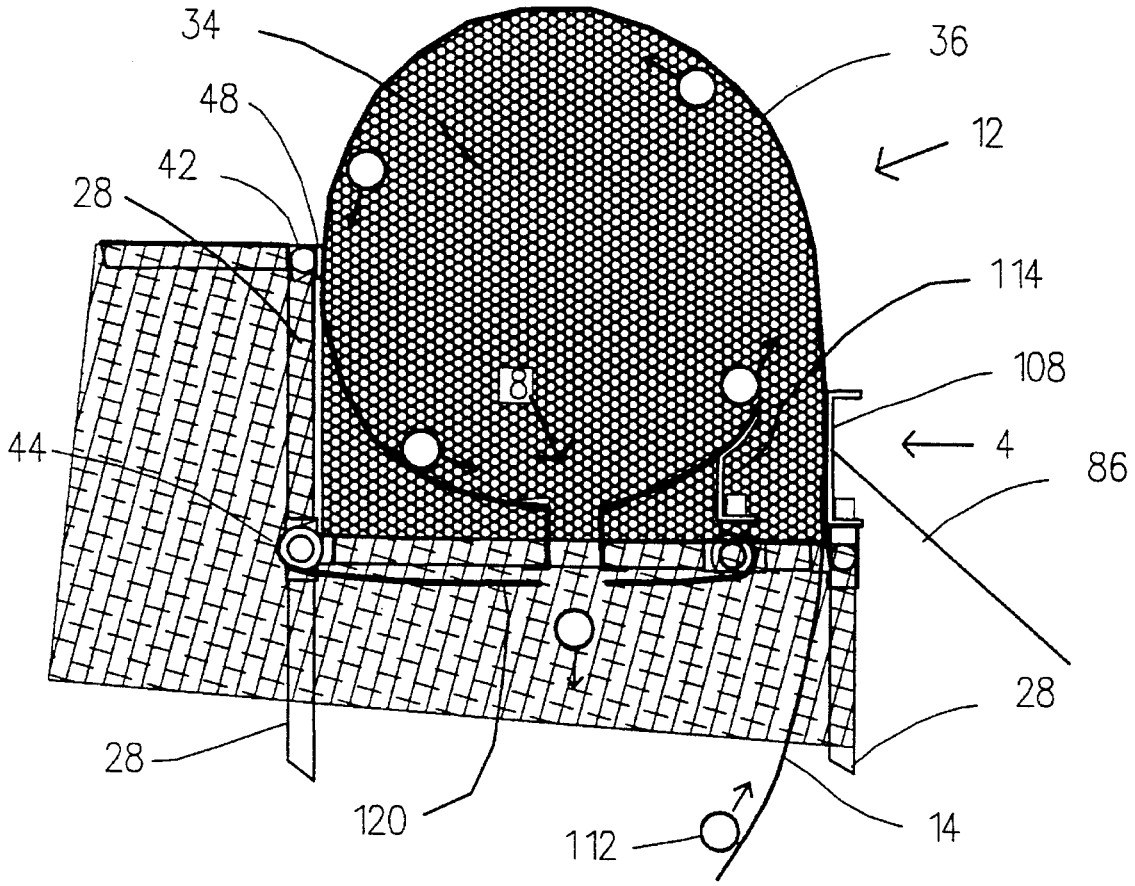
FIG. 3 is an enlarged cross sectional view of the cylindrical shot receiver area.
Figure 4:
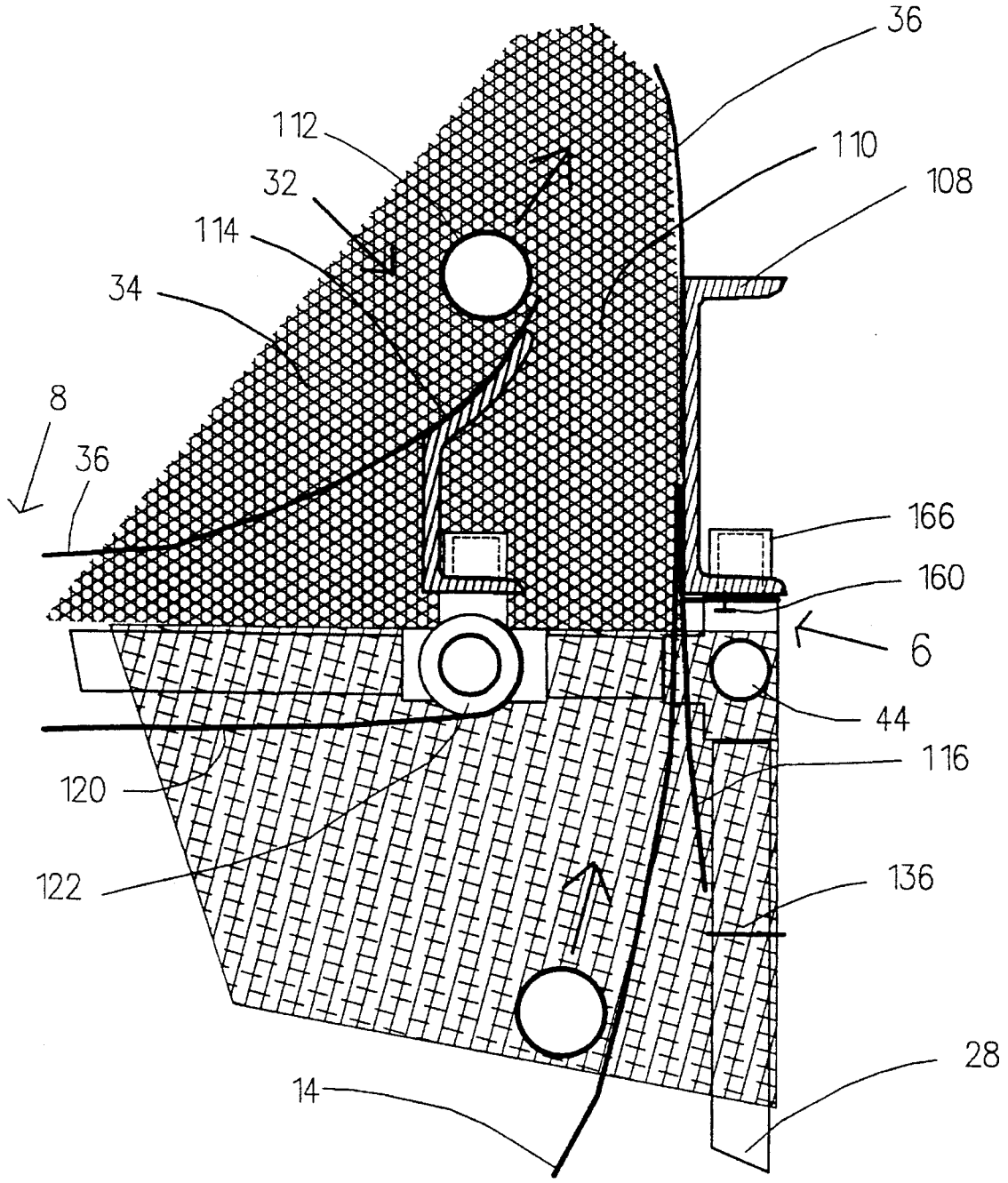
FIG. 4 is a large scale cross sectional view of the cylindrical shot receiver.
Figure 6:
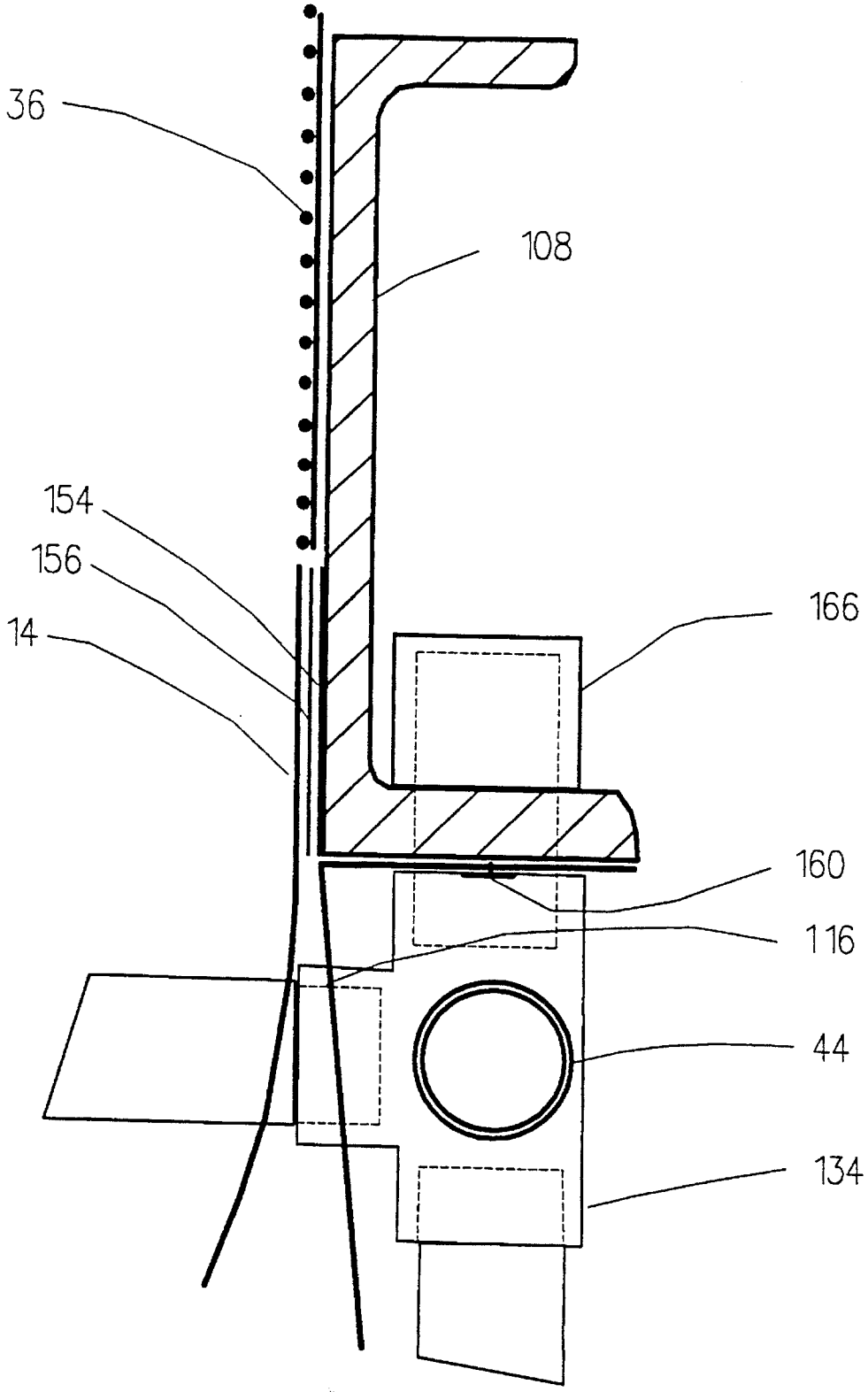
FIG. 6 is a large scale cross section of the fabric ramp attachment to the main beam.

The shot receiver 12, as best seen in FIGS. 3, 4, and 6, is a generally cylindrical net 36 formed of self-supporting mesh net material such as woven, expanded or knitted metal, plastic or metal reinforced plastic matrix that takes on a horizontally oriented generally cylindrical shape from a plurality of attachment points on a main beam 108, the support tubes 42, an attachment strip 48, ball return strongback 168, and shaped beam 114. The main beam 108 and the shaped beam 114 may be made of metal, plastic, wood or composite material. The main beam 108 is designed to attach to the tubular frame members in several places via tubing fasteners 166, using set screws, or other conventional fastening means and transmit its structural loading to the device frame. The attachment strip 48 connects the self-supporting mesh to the frame tube support 42 at a plurality of points. A continuous strip consisting of the hook side of a hook and loop fastener 154 is attached to the lower face of the main beam 108 at a plurality of points.

The ends of the generally cylindrical shot receiver net 36 are enclosed by left and right shot receiver end nets 34 and 38 to prevent golf balls from leaving the shot receiver 12 and are made of similar self-supporting open mesh or more flexible plastic netting.

As shown in FIGS. 1 and 2, the leading edge 60 of the semi-rigid, tensioned, upwardly curving main impact net fabric ramp 14 is secured to the ground or floor surface at its leading edge and is connected at its trailing edge to the main beam 108 at the lower edge of the shot receiver 12 (FIGS. 3, 4, and 6). The main impact net fabric ramp 14 has a reinforced impact area 16 which extends from the leading edge to the attach point on the main beam 108. The main impact net fabric ramp 14 and the reinforced impact area 16 may be made of single or multiple layers of extraordinarily strong plastic or wire reinforced plastic, nylon, canvas, kevlar which is woven, knitted, sewn, expanded or otherwise manufactured into a strong matrix of fabric. The resulting net fabric ramp 14 must allow the wind to pass through to some extent. The leading edge 60 of the ramp 14 may be reinforced with plastic strapping, sewn or attached to the main net in a plurality of points, and looped over on itself to form a sleeve to accept bent hold down bars 70. A centerline 90 or other graphic designs may be imprinted on the teeing area 82 and fabric ramp 14.

During high wind conditions where the wind is from the direction opposite the teeing area, the main impact net fabric ramp 14 is restrained from inflating like a sail by a main impact net fabric ramp anti-sail restraint 106 which is attached at its upper end to the main impact fabric ramp 14 and its lower end is held fast to the ground by short stakes 94.

The various netting panels embody elongated cords, cables or loop and hook fasteners at the corners or juncture lines 52 where the margins of adjacent nets meet to which such margins are sewn or otherwise fastened. Except for the front edge of the main impact net fabric ramp 14, each of the cables is secured to a rigid frame tubing member by a plurality of attachment members or netting cable ties 136, and the cables at the net junctures 52 serve to substantially and uniformly distribute the weight of the tension forces developed by the attachments.

As shown in FIG. 6, the netting elements are typically secured to the frame members with cable ties 136 with the exception of the leading edge of the main impact net fabric ramp 14 to the main beam 108. The self-supporting mesh net 36 is attached and fastened to the main beam 108 at a plurality of points. A continuous strip consisting of the hook side of a hook and loop fastener 154 is attached to the lower face of the main beam 108 at a plurality of points. The main impact net 14 rises to attach to the main beam 108 via a continuous strip of the loop side of a hook and loop fastener 156 that is sewn or similarly attached to the main impact net fabric ramp 14.

A guide angle 116 made of sheet metal or thin plastic sheet is attached by fasteners 160 to the bottom of the main beam 108 to assist high velocity golf balls from slightly bumping the bottom edge of the main beam 108 as the main impact net fabric ramp 14 slightly deflects.

As best seen in FIG. 4, the trailing edge of the self-supporting mesh net 36 is supported on a shaped beam 114 which extends across the lower portion of the net 36 and terminates just past the beam. The beam 114 is curved and in combination with the self-supporting mesh 36 forms a launching ramp assembly 32 inside the shot receiver 12. The ramp assembly 32 is positioned forwardly from the rear surface of the net 36 and main beam 108 to define a ball entry opening 110 which extends the width of the shot receiver 12.

Figure 8:
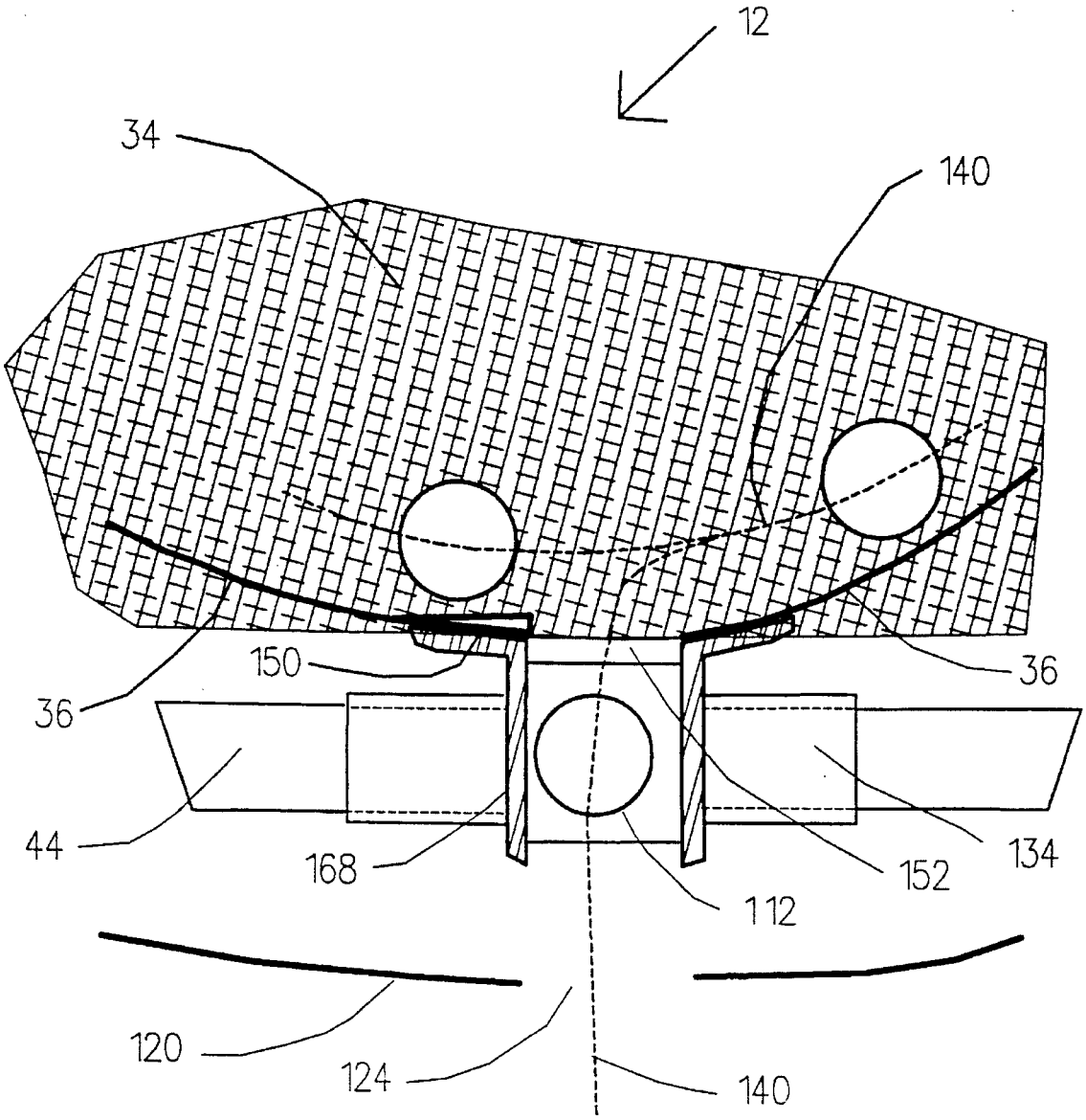
FIG. 8 is a large scale cross section of the golf ball return feature.

As shown in FIG. 8, the shot receiver 12 may employ a series of ball return openings 152 to deliver the golf ball 112 back to the golfer under gravity. A golf ball return launching ramp 150 lifts the golf ball 112 slightly above the ball return opening 152. The line of the golf ball's path 140 is indicated by dashed lines for clarity. When the forward velocity of the golf ball 112 is depleted, the force of gravity will return it to the bottom of the shot receiver 12 where it will fall through the ball return opening 152 and drop onto the main impact net fabric ramp 14 and subsequently roll back downward to the teeing area 82. The line of the golf ball's path 140 is illustrated for clarity. The ball return launching ramp 150 may be made of wood, metal or plastic and attached at a plurality of points to the self-supporting mesh 36.

Attached to and supporting the lower portion of the shot receiver 12 and the ball return openings 152 is a ball return opening strongback 168 which is attached at the ends to the frame tubing 44 via tubing connectors 134. Safety netting 120 is suspended underneath the shot receiver 12 and also contains a series of net openings 124 to allow golf balls to fall through on their way back to the teeing area 82 via the fabric ramp 14. The strongback 168 may be made of metal or plastic and reinforced at each opening.

As shown in FIG. 4, safety netting 120 protects the bottom of the shot receiver 12 from a mis-hit shot. The exposed frame elements may also be covered with foam safety padding 122 to protect them from possible mis-hits.

As shown in FIG. 1, side safety nets 18 supported on the vertical and sloping support tubes 28 and 46 extend forward and outwardly from the shot receiver 12 and protect the surroundings from mis-hit shots. The safety nets 18 are shaped to allow the golfer to stand reasonably close to the device without hitting the side netting with the golf club.

Figure 7:
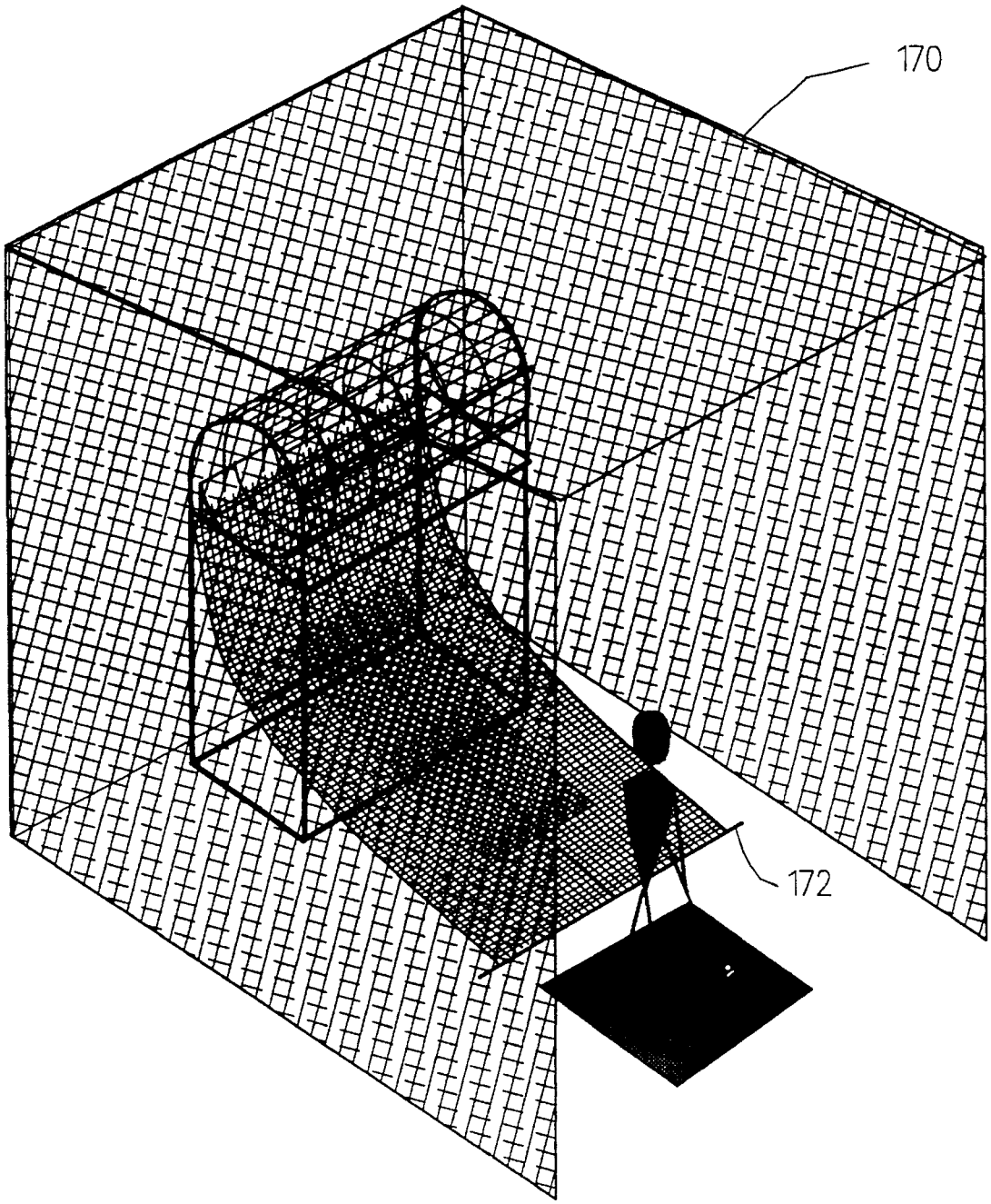
FIG. 7 is a perspective view of a variation of the compact driving range net apparatus inside a much larger netting assembly to completely enclose the golfer and the apparatus.

Alternatively, FIG. 7 shows a modification of the compact golf driving range net wherein the side nets 18 are eliminated and the apparatus is located inside a larger, fully enclosed conventional net cage enclosure 170 for safety purposes. If located indoors, an edge restraint 172 would attach the leading edge of the main impact net fabric ramp 14 to the floor, otherwise, if located outdoors the conventional bent hold down bar 70 would fix the leading edge. Foam safety padding would cover frame elements exposed to possible mis-hits.

OPERATION

As shown in FIGS. 1 and 2, a golfer 80 would set up at the teeing area 82 and drive golf balls into the main impact net fabric ramp 14 along the aiming centerline 90 and observe the ball as it rotates inside the shot receiver 12. Since a plurality of golf clubs are intended to be used with this device, no specific target has been defined, however, a centerline has been illustrated as a linear target where various clubs should endeavour to impact the ball. When the ball 112 is hit, it first contacts the upwardly curving main impact net fabric ramp 14 losing a small amount of its energy as the main impact net deflects slightly and it travels up the fabric ramp 14. The ramp continues to redirect the initially horizontal velocity vector of the golf ball into a nearly vertical vector where it enters the shot receiver 12 through the ball entry opening 114 (FIG. 3) and travels around its curved cylindrical surface and off of the launching ramp assembly 32 (FIG. 4). The guide angle 116 assists high velocity golf balls from slightly bumping the bottom edge of the main beam 108 as the main impact net fabric ramp 14 slightly deflects. The launching ramp 150 lifts the golf ball 112 slightly above the ball return openings 152 (FIG. 8).

The cylindrical shot receiver 12 will allow a golf ball to rotate and spiral under centrifugal force until its energy is spent. After striking the golf ball, the golfer is naturally facing the cylindrical shot receiver 12 and visually watches the path that the golf ball takes as it revolves inside of the shot receiver 12. As a high velocity golf ball enters the receiver 12, the centrifugal force on the ball keeps it pressed tightly against the inner surface of the open mesh as it passes over the launching ramp 32 and around the inside of the shot receiver a plurality of times. Watching the track of the golf ball as it rotates inside the cylindrical receiver reveals the resultant shot. Rotation to the right of center indicates a pushed, fade or sliced shot. Rotation to the left indicates a pulled, draw or hooked shot. The closer the golf ball stays to the centerline indicates the correctness of the particular golf shot, assuming the golfer was lined up square to the centerline. Finally, the more revolutions around the receiving cylinder the longer the flight of the ball.

It should be understood that the shot receiver 12 of the net apparatus might embody various other interior surfaces which may allow a longer observation time; i.e., the golf ball would revolve for a longer time as a result of a smoother interior surface.

As shown in dashed line 140 in FIG. 8, when the forward velocity of the golf ball 112 is depleted the force of gravity will return it to the bottom of the shot receiver 12 where it will fall through the ball return opening 152 and drop onto the main impact net fabric ramp 14 and subsequently roll back downward to the teeing area 82. Balls may also fall through the openings 124 in the safety netting 12 beneath the shot receiver 12.

Reading the rotations of the golf ball is made easier by gradations placed on the side of said shot receiving cylinder facing the golfer. In a short period of time, the golfer learns to watch the movement of the ball once it has entered the shot receiver, noting if it entered left or right of the centerline 90.

Typical conventional golf nets merely stop a golf ball after allowing a golf ball flight of about 3 meters (8 to 10 feet) from the point of golf club impact to point of net impact. This is hardly enough to judge if the ball was struck well or judge if excessive side spin on the golf ball was present. The present compact golf driving range net allows the golf ball to travel approximately 30 meters (100 feet) by allowing it to rotate around a cylindrical shot receiver. A factor of approximately 10 times greater, thus, allowing some 3 to 4 seconds to observe the movement of the ball. This time of flight is approximately 50% of the flight time that a golf ball would have under normal driving range conditions.

The present compact golf driving range net allows the golfer to use a full swing and/or partial swing with most golf clubs. The number of golf clubs used is limited only by the height of the shot receiver above the teeing area. For example, a low height shot receiver would be used with long irons, fairway woods and driver. A medium height shot receiver would allow the use of a driver through 7 iron. A high height shot receiver would allow the use of a driver through wedge.

The present net assembly could be located adjacent to the first tee of a golf course and used if the normal driving range is unavailable. The golfer would use his/her own ball because it would be returned to them. This would allow several warm up shots just prior to the actual tee shot that would begin that round of golf.

It should be understood that the ball return may also be eliminated wherein spent golf balls collect in the shot receiver 12 and are emptied by tilting one of the shot receiver end nets 34 or 38 open and retrieving the golf ball by reaching into the shot receiver 12. The golf driving range net apparatus could alternatively embody a trough located underneath the shot receiver that spent golf balls would fall into and be returned to either a capture device for coin operated purposes or returned to the golfer at the tee area via a plastic conduit of sorts. Additional safety netting may also be provided to prevent damage to the Shot receiver or property located around the device. The present golf driving range net apparatus might also embody an integrated teeing area where a grid work of alignment aids, lines and mirrors would assist the golfer to assure practice was conducted in a "square to the line" manner.

While this invention has been described fully and completely with special emphasis upon a preferred embodiment, it should be understood that within the scope of the appended claims the invention may be practiced otherwise than as specifically described herein.

I claim:

1. A compact golf driving range net apparatus comprising:

a frame of elongate support members releasably connected together, said frame supported adjacent a teeing area on a support surface;

a substantially fabric ramp having a lower leading edge releasably connected to a lower portion of said frame adjacent said teeing area and an upper trailing edge releasably connected to an upper end of said frame, said ramp curving progressively upward from said leading edge to said trailing edge and supported on said frame in a substantially tensioned state; and a substantially cylindrical ball receiving member formed of material through which an object may be viewed supported generally horizontally at an upper end of said frame above said ramp and having a longitudinal opening in communication with said fabric ramp upper trailing edge for receiving a ball thereinto; whereby golf balls hit by a golfer from said teeing area will impact said fabric ramp and be guided progressively upward thereby and rotate along the interior surface of said ball receiving member a number of times under observation of said golfer and the path of said rotating golf ball being indicative of the manner in which it was hit.

2. A compact golf ball driving range net apparatus according to claim 1 wherein said substantially cylindrical ball receiving member is formed of semi-rigid open mesh.

3. A compact golf ball driving range net apparatus according to claim 1 wherein said elongate support members comprise a plurality of vertical, horizontal, and sloping rigid tubular members releasably connected together.

4. A compact golf ball driving range net apparatus according to claim 3 wherein said rigid tubular members are substantially covered by a cushioning material.

5. A compact golf ball driving range net apparatus according to claim 1 further comprising a plurality of footpad members releasably connected to a bottom surface of said frame for supporting said frame on said support surface.

6. A compact golf ball driving range net apparatus according to claim 1 further comprising anchoring means releasably connected between said frame and said support surface to prevent movement of said frame.

7. A compact golf ball driving range net apparatus according to claim 1 further comprising tensioning means connected between said ramp and said support surface for maintaining said ramp in the substantially tensioned state.

8. A compact golf ball driving range net apparatus according to claim 1 further comprising guide markings on said ramp visible to the golfer representing the desired path a golf ball would follow when properly hit by a golf club, the deviation of said rotating golf ball with respect to said markings representing the manner in which the said ball was hit by the face of the golf club, and the number of rotations inside said substantially cylindrical ball receiving member representing the distance said ball would have traveled.

9. A compact golf ball driving range net apparatus according to claim 1 further comprising netting enclosing the laterally opposed ends of said substantially cylindrical ball receiving member.

10. A compact golf ball driving range net apparatus according to claim 1 further comprising safety netting supported on each side of said substantially fabric ramp and suspended beneath said ball receiving member to arrest mis-hit golf balls.

11. A compact golf ball driving range net apparatus according to claim 1 wherein one side of said substantially cylindrical ball receiving member longitudinal opening is joined generally tangential to said ramp upper trailing edge, and said ball receiving member having an interior surface curving inward toward itself and terminating a distance outwardly from the tangential juncture to define an opposed side of said longitudinal opening.

12. A compact golf ball driving range net apparatus according to claim 11 further comprising an elongate support beam releasably connected generally horizontally to an upper end of said frame and having a generally vertical surface for supporting said ramp trailing edge at its juncture with said ball receiving member.

13. A compact golf ball driving range net apparatus according to claim 12 further comprising an elongate guide member connected with said support beam and forming a generally horizontal extension depending from said vertical surface and positioned behind said ramp trailing edge to assist in preventing high velocity golf balls from bumping a bottom edge of said support beam should the velocity cause flexure of said substantially fabric ramp.

14. A compact golf ball driving range net apparatus according to claim 11 further comprising an elongate shaped beam connected to an upper end of said frame and extending generally horizontally through said substantially cylindrical ball receiving member and having a curved surface supporting the terminal end of said interior surface to direct golf balls across said longitudinal opening as they travel along the curved interior surface of said ball receiving member.

15. A compact golf ball driving range net apparatus according to claim 11 further comprising ball return openings in a lowermost portion of said inwardly curved interior surface of said ball receiving member for allowing golf balls with very low velocities to exit said ball receiving member under the force of gravity.

16. A compact golf ball driving range net apparatus according to claim 15 further comprising an angled surface extending longitudinally along said inwardly curved interior surface of said substantially cylindrical ball receiving member and having a raised end adjacent said ball return openings to direct golf balls across said ball return openings as they travel along the curved interior surface of said ball receiving member.

17. A compact golf ball driving range net apparatus according to claim 15 further comprising an elongate ball return member connected to an upper end of said frame and extending generally horizontally through said substantially cylindrical ball receiving member and having a curved surface supporting said lowermost portion of said inwardly curved interior surface of said ball receiving member and having openings therethrough in alignment with said ball return openings through which said golf balls with very low velocities pass when exiting said ball receiving member under the force of gravity.

* * * * *